US010287893B2

(12) United States Patent
Cho et al.

(10) Patent No.: US 10,287,893 B2
(45) Date of Patent: May 14, 2019

(54) TURBINE

(71) Applicant: HANWHA AEROSPACE CO., LTD., Changwon-si (KR)

(72) Inventors: Myunghwan Cho, Changwon-si (KR); Jaekyung Sim, Changwon-si (KR)

(73) Assignee: HANWHA AEROSPACE CO., LTD., Changwon-si (KR)

( * ) Notice: Subject to any disclaimer, the term of this patent is extended or adjusted under 35 U.S.C. 154(b) by 448 days.

(21) Appl. No.: 14/541,716

(22) Filed: Nov. 14, 2014

(65) Prior Publication Data

US 2015/0139813 A1 May 21, 2015

(30) Foreign Application Priority Data

Nov. 15, 2013 (KR) ..... 10-2013-0139329

(51) Int. Cl.
*F01D 5/18* (2006.01)

(52) U.S. Cl.
CPC .... *F01D 5/187* (2013.01); *F05D 2260/22141* (2013.01)

(58) Field of Classification Search
CPC ..... F01D 5/12; F01D 5/187; F01D 5/183
USPC ..... 416/97 R
See application file for complete search history.

(56) References Cited

U.S. PATENT DOCUMENTS

| | | | | |
|---|---|---|---|---|
| 4,407,632 | A * | 10/1983 | Liang | F01D 5/187 415/115 |
| 5,738,493 | A | 4/1998 | Lee et al. | |
| 5,752,801 | A | 5/1998 | Kennedy | |
| 6,446,710 | B2 * | 9/2002 | Beeck | F01D 5/187 137/809 |
| 7,163,373 | B2 * | 1/2007 | Liang | F01D 5/18 415/115 |
| 7,186,084 | B2 * | 3/2007 | Bunker | F01D 5/187 416/241 R |
| 8,511,977 | B2 * | 8/2013 | Hillier | F01D 5/18 415/178 |
| 8,807,945 | B2 * | 8/2014 | Spangler | F01D 5/187 415/115 |
| 9,194,236 | B2 * | 11/2015 | Nakamata | F01D 5/187 |

FOREIGN PATENT DOCUMENTS

| | | | |
|---|---|---|---|
| EP | 2282009 | A1 | 2/2011 |
| JP | 05-179902 | A | 7/1993 |
| JP | 3053174 | B2 | 6/2000 |
| JP | 2006-242050 | A | 9/2006 |
| JP | 4063937 | B2 | 3/2008 |

* cited by examiner

*Primary Examiner* — Justin D Seabe
*Assistant Examiner* — Jason Mikus
(74) *Attorney, Agent, or Firm* — Sughrue Mion, PLLC

(57) ABSTRACT

Provided is a turbine including a rotor; a blade provided on the rotor and comprising a cooling flow path through which a cooling fluid flows; and a shroud surrounding an exterior of the blade, wherein the blade includes: at least one rib turbulator protruding into the cooling flow path; and at least one subsidiary protrusion protruding from an outer surface of the at least one rib turbulator.

12 Claims, 4 Drawing Sheets

TURBINE

CROSS-REFERENCE TO RELATED APPLICATION

This application claims priority from Korean Patent Application No. 10-2013-0139329, filed on Nov. 15, 2013, in the Korean Intellectual Property Office, the disclosure of which is incorporated herein by reference in its entirety.

BACKGROUND

1. Field

Apparatuses consistent with exemplary embodiments relate to a turbine, and more particularly, to a turbine capable of effectively cooling a blade.

2. Description of the Related Art

A turbine is an apparatus which generates energy or power by using various fluids. The turbine may be typically connected to a burner and a compressor. Also, the turbine may be connected to a heater configured to supply water vapor. When the turbine is connected to the burner and the compressor, a cooling fluid supplied from the compressor may be mixed with fuel and burned in the burner, and a combustion gas may be supplied to the turbine. In this case, the turbine may rotate at least one blade by using the combustion gas supplied from the burner and externally transmit power.

When the combustion gas is supplied to the turbine as described above, a surface temperature of the at least one blade may increase. In particular, a rise in the surface temperature of the blade may lead to deformation or a breakdown of the at least one blade. To mitigate such deformation or breakdown, a cooling fluid may be supplied into the blade to prevent the surface temperature of the at least one blade from rising above a design limit during an operation of the turbine.

SUMMARY

One or more exemplary embodiments provide a turbine capable of effectively cooling a blade.

Additional aspects will be set forth in part in the description which follows and, in part, will be apparent from the description, or may be learned by practice of the exemplary embodiments.

According to an aspect of an exemplary embodiment, there is provided a turbine including: a rotor; a blade provided on the rotor and comprising a cooling flow path through which a cooling fluid flows; and a shroud surrounding an exterior of the blade, wherein the blade includes: at least one rib turbulator protruding into the cooling flow path; and at least one subsidiary protrusion protruding from an outer surface of the at least one rib turbulator.

The at least one rib turbulator may include a plurality of rib turbulators protruding into the cooling flow path to face one another.

The at least one rib turbulator may include a plurality of rib turbulators provided apart from one another along the cooling flow path.

The at least one rib turbulator may include a plurality of rib turbulators provided apart from one another in an axial direction of the blade.

The at least one turbulator may axially extend at a first angle with respect to a flow direction of the cooling fluid which flows in the cooling flow path.

The at least one subsidiary protrusion may include a plurality of subsidiary protrusions arranged in a straight line apart from one another, and the straight line along which the plurality of subsidiary protrusions are disposed may form a second angle with respect to a flow direction of the cooling fluid which flows in the cooling flow path.

The at least one subsidiary protrusion may be provided on a top surface of the at least one rib turbulator at a downstream side of a flow direction of the cooling fluid that flows in the cooling flow path.

The at least one rib turbulator extending in an axial direction may form a first angle with a flow direction of the cooling fluid.

The at least one subsidiary protrusion extending in the axial direction may form a second angle with the flow direction of the cooling fluid.

The first angle and the second angle may be equal.

The first angle and the second angle may be different from each other.

BRIEF DESCRIPTION OF THE DRAWINGS

The above and/or other aspects will become apparent and more readily appreciated from the following description of exemplary embodiments, taken in conjunction with the accompanying drawings in which.

DETAILED DESCRIPTION

Figure 1:
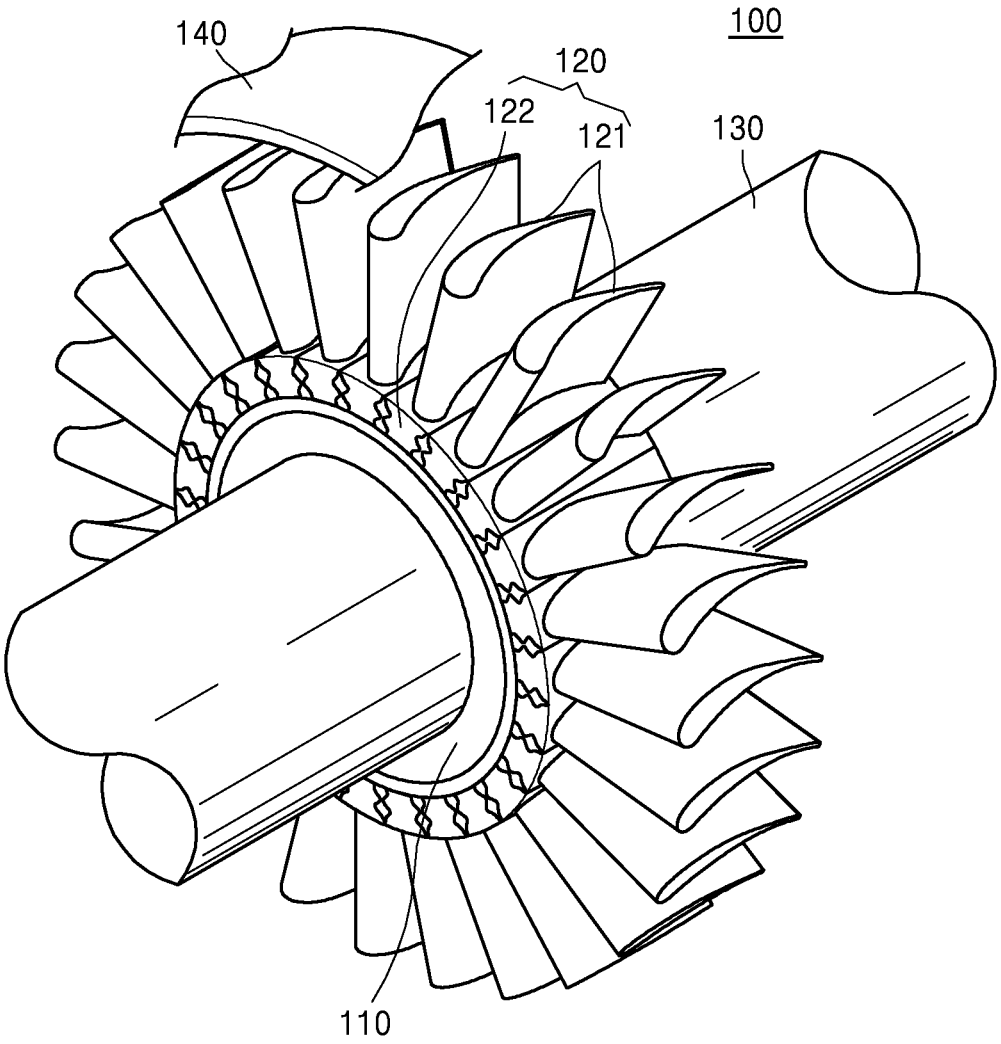
FIG. 1 is a partial perspective view of a turbine according to an exemplary embodiment.

Reference will now be made in detail to exemplary embodiments, examples of which are illustrated in the accompanying drawings, wherein like reference numerals refer to like elements throughout. In this regard, the present embodiments may have different forms and should not be construed as being limited to the descriptions set forth herein. Accordingly, the exemplary embodiments are merely described below, by referring to the figures, to explain aspects of the present description.

The inventive concept is described more fully hereinafter with reference to the accompanying drawings, in which exemplary embodiments of the inventive concept are shown. This inventive concept may, however, be embodied in many different forms and should not be construed as limited to the embodiments set forth herein. Rather, the exemplary embodiments are provided so that this disclosure will be thorough and complete, and will fully convey the scope of the inventive concept to those skilled in the art. The terminology used herein is for the purpose of describing particular embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that, although the terms first, second, etc. may be used herein to describe various elements, components, regions, layers and/or sections, these elements, components, regions, layers and/or sections should not be limited by these terms. Thus, a first element, component, region, layer or section discussed below could be termed a second element, component, region, layer or section without departing from the teachings of the inventive concept.

Figure 2:
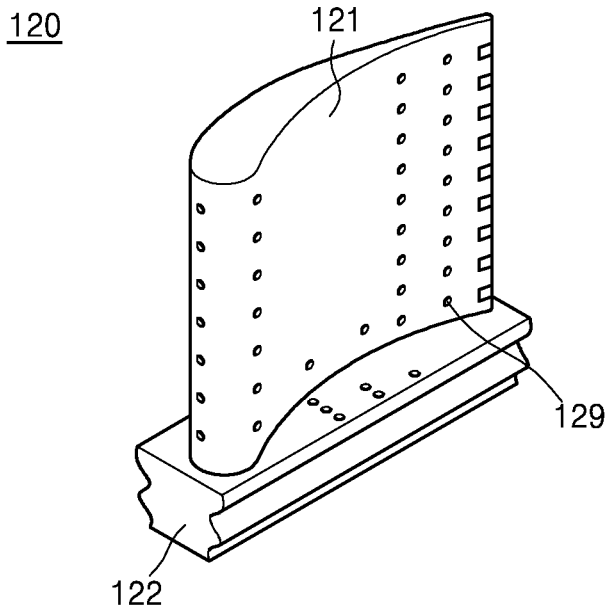
FIG. 2 is a perspective view of a blade shown in FIG. 1 according to an exemplary embodiment.
Figure 3:
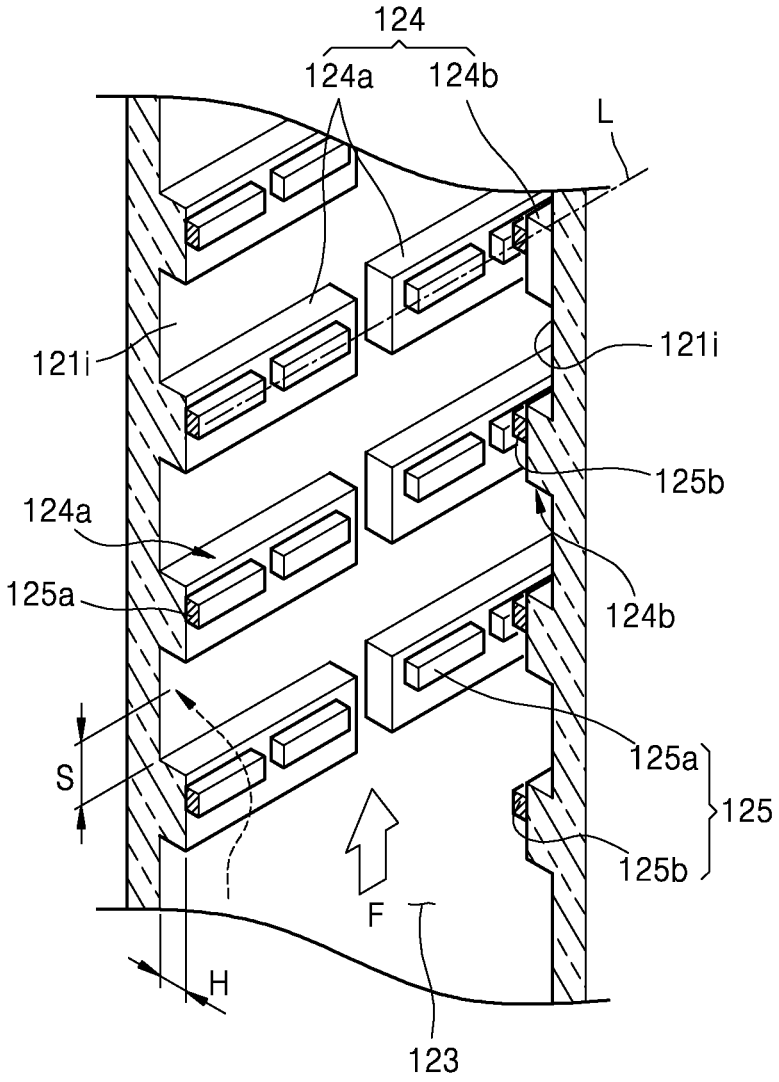
FIG. 3 is a partial perspective view of part of a cooling flow path formed in the blade shown in FIG. 2 according to an exemplary embodiment.

FIG. 1 is a partial perspective view of a turbine 100 according to an exemplary embodiment, FIG. 2 is a perspective view of a blade 120 shown in FIG. 1 according to an exemplary embodiment, and FIG. 3 is a partial perspective view of part of a cooling flow path formed in the blade 120 shown in FIG. 2 according to an exemplary embodiment.

Referring to FIGS. 1 through 3, the turbine 100 may include a case (not shown) that forms an outer appearance of the turbine 100. The turbine 100 may include a rotor 110 that is rotatably installed within the case. The rotor 110 may be connected to a shaft 130 which may be connected to an external apparatus (not shown).

The turbine 100 may include a blade 120 installed at the rotor 110. The blade 120 may include a cooling flow path 123 through which a cooling fluid flows. In this case, the blade 120 may include a dove tail 122 installed to be inserted into the rotor 110, and a blade body unit 121 formed to extend from the dove tail 122. In particular, the cooling flow path 123, in which a cooling fluid that has flowed into the rotor 110 flows, may be formed inside the blade body unit 121.

The turbine 100 may include a shroud 140 fixed to the case and installed to surround an exterior of the blade 120 in the radial direction.

Referring to FIG. 3, the blade 120 may include at least one rib turbulator 124 formed to protrude into the cooling flow path 123 from an inner surface 121*i* of the blade body unit 121. That is, the rib turbulator 124 may be formed stepwise from the inner surface 121*i* of the blade body unit which constitutes the cooling flow path 123. Also, the blade 120 may include at least one subsidiary protrusion 125 protruding from an outer surface of the rib turbulator 124.

Hereinafter, a plurality of rib turbulators 124 may be described in more detail. For example, a pair of rib turbulators 124 may be formed and installed opposite of each other. Specifically, the plurality of rib turbulators 124 may include a first rib turbulator 124*a* and a second rib turbulator 124*b* formed opposite the first rib turbulator 124*a*. In this case, the first rib turbulator 124*a* may be formed on a first inner face 121*i* and the second rib turbulator 124*b* may be formed on a second inner face 121*i* facing the first inner face of the blade body unit 121. The plurality of first rib turbulators 124*a* formed as described above may be installed a predetermined distance apart from one another in a lengthwise direction (i.e. a radial direction of the turbine 100) of the cooling flow path 123. Also, similar to the first rib turbulators 124*a*, the plurality of second rib turbulators 124*b* may be installed a predetermined apart from one another in the lengthwise direction (i.e. a radial direction of the turbine 100) of the cooling flow path 123.

Furthermore, each of the first rib turbulator 124*a* and the second rib turbulator 124*b* may be disposed to make an angle with a flow direction F of a cooling fluid that flows in the cooling flow path 123. In particular, a longest portion extending in an axial direction of each of the first rib turbulator 124*a* and the second rib turbulator 124*b* may be disposed to form a first angle with the flow direction F of the cooling fluid that moves in the cooling flow path 123.

The first rib turbulator 124*a* and the second rib turbulator 124*b* may be formed in various shapes. For example, each of the first rib turbulator 124*a* and the second rib turbulator 124*b* may have a hemispheric shape, a cylindrical shape, or a polygonal pillar shape, such as a square pillar shape, a rectangular pillar shape or a triangular pillar shape. Hereinafter, for brevity, a case in which each of the first rib turbulator 124*a* and the second rib turbulator 124*b* is formed in a rectangular pillar shape will chiefly be described in detail.

At least one subsidiary protrusion 125 may be formed on each of the first rib turbulator 124*a* and the second rib turbulator 124*b*. Hereinafter, for brevity, a subsidiary protrusion 125 formed on the first rib turbulator 124*a* will be referred to as a first subsidiary protrusion 125*a*, while a subsidiary protrusion 125 formed on the second rib turbulator 124*b* will be referred to as a second subsidiary protrusion 125*b*.

The first subsidiary protrusion 125*a* and the second subsidiary protrusion 125*b* may be formed on top surfaces (facing the cooling flow path 123) of the first rib turbulator 124*a* and the second rib turbulator 124*b*, respectively. In particular, the first subsidiary protrusion 125*a* may be formed to protrude from the first rib turbulator 124*a* toward the second rib turbulator 124*b*, and the second subsidiary protrusion 125*b* may be formed to protrude from the second rib turbulator 124*b* toward the first rib turbulator 124*a*.

A plurality of first subsidiary protrusions 125*a* and a plurality of second subsidiary protrusions 125*b* may be provided. In this case, the plurality of first subsidiary protrusions 125*a* may be disposed along a straight line L, and the plurality of second subsidiary protrusions 125*b* may be disposed along a straight line L as shown in FIG. 3. In this case, since the first subsidiary protrusion 125*a* and the second subsidiary protrusion 125*b* are formed to have the same shape and size or similar shapes and sizes, the first subsidiary protrusion 125*a* will chiefly be described in detail.

Figure 4A:
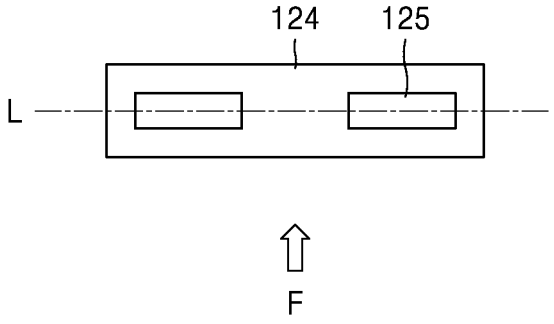
FIGS. 4A and 4B are views illustrating different embodiments of subsidiary protrusions.
Figure 4B:
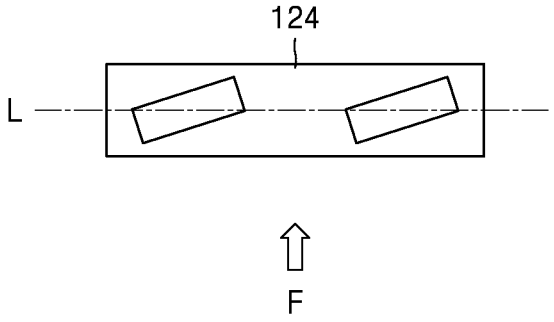

As described above, the plurality of first subsidiary protrusions 125*a* may be provided and disposed in a straight line L. In this case, the straight line L in which the plurality of first subsidiary protrusions 125*a* are formed may form a second angle with the flow direction F of the cooling fluid that flows in the cooling flow path 123. In this case, the first angle may be equal to (FIG. 4A) or different (FIG. 4B) from the second angle. Hereinafter, a case in which the first angle is equal to the second angle and the cooling fluid forms a right angle with the flow direction F will chiefly be described in detail.

The first subsidiary protrusion 125*a* may be formed on the top surface of the first rib turbulator 124*a*. Specifically, the first subsidiary protrusion 125*a* may be formed on the top surface of the first rib turbulator 124*a*, which is far from an entrance side of the cooling flow path 123.

The turbine 100 may be operated in various forms. Specifically, the turbine 100 may operate using a combustion gas supplied from a burner (not shown) or receive water vapor and operate. Hereinafter, for brevity, a case in which the turbine 100 operates using the combustion gas will chiefly be described in detail.

The turbine 100 may supply a cooling fluid compressed by a compressor (not shown) to the burner and then receive a combustion gas generated by burning the cooling fluid and fuel from the burner. In this case, when the combustion gas is supplied, the combustion gas may rotate the blade 120 of the turbine 100. The blade 120 may rotate to rotate the rotor 110, and the rotor 110 may supply rotary power to an external apparatus connected through the shaft 130 (e.g., a power generator or a mechanism).

During the above-described operation, the blade 120 may rotate between the rotor 110 of the shroud 140. In this case, an outer surface temperature of the blade 120 may increase due to the combustion gas and the rotation of the blade 120.

When the outer surface temperature of the blade 120 increases as described above, the blade 120 may be damaged or deformed due to thermal fatigue. To prevent the surface temperature of the blade 120 from increasing, part of the cooling fluid compressed by the compressor may be supplied into the blade 120. In this case, while flowing through the cooling flow path 123 of the blade 120, the cooling fluid may partially absorb heat of the blade 120. In addition, the cooling flow path 123 may be connected to a spray hole 129 formed in a surface of the blade 120 so that the cooling fluid may be sprayed toward the surface of the blade 120. Thus, a fluid layer may be formed on the surface of the blade 120 and prevent a temperature of the blade 120 from increasing above the design temperature due to the combustion gas.

During the above-described operation, the cooling fluid that flows in the cooling flow path 123 may collide with inner surfaces 121*i* of the blade body unit 121 forming the cooling flow path 123. In this case, as a distance by which the cooling fluid collides with the inner surfaces 121*i* of the blade body unit 121 forming the cooling flow path 123 becomes shorter and as the number of times collision of the cooling fluid with the surface of the cooling flow path 123 is repeated becomes larger, a rise in temperature of the blade 120 may be further inhibited.

Specifically, the cooling fluid that flows in the cooling flow path 123 may collide with the first rib turbulator 124*a* and the second rib turbulator 124*b* to form an elliptical flow, and collide with the inner surfaces 121*i* of the blade body unit 121 forming the cooling flow path 123. Also, the cooling fluid may form a vortex in a portion lower than a stepped portion of the first rib turbulator 124*a* and a stepped portion of the second rib turbulator 124*b* at a downstream side of the flow direction F of the cooling fluid, and determine a length of an elliptical movement of the cooling fluid.

A cooling fluid that has collided with one corner of the first rib turbulator 124*a* may collide with one corner of the first subsidiary protrusion 125*a* again. In this case, a small vortex may be formed at the first subsidiary protrusion 125*a*, and a reattachment length S of the cooling fluid that has collided with the first rib turbulator 124*a* may be reduced due to the vortex formed at the first subsidiary protrusion 125*a*. In particular, the first subsidiary protrusion 125*a* may reduce the size of the vortex generated by the first rib turbulator 124*a* at the rear of the flow of the cooling fluid.

Specifically, when only the first rib turbulator 124*a* is provided, a reattachment length S of the cooling fluid that has collided with the surface of the cooling flow path 123 after the cooling fluid collided with the first rib turbulator 124*a* may be about 8 times a distance H between the inner surface 121*i* of the blade body unit 121 and the top surface of the first rib turbulator 124*a*. In particular, the size of a vortex generated by the first rib turbulator 124*a* at a rear side of the flow of the cooling fluid may be increased to increase the reattachment length S of the cooling fluid.

However, when the first rib turbulator 124*a* and the first subsidiary protrusion 125*a* are provided, the size of a vortex generated at the rear of the first rib turbulator 124*a* may be minimized by the first subsidiary protrusion 125*a* as described above. In particular, when the size of the vortex generated at the rear of the first rib turbulator 124*a* is reduced, the flow of the cooling fluid may not be precluded so that the reattachment length S of the cooling fluid may be reduced to be less than 8 times a distance H between the inner surface 121*i* of the blade body unit 121 and the top surface of the first rib turbulator 124*a*.

Accordingly, the turbine 100 may reduce the reattachment length S of the cooling fluid that has collided with the first rib turbulator 124*a* and the second rib turbulator 124*b* so that the cooling fluid may frequently collide with the inner surface 121*i* of the blade body unit 121. In particular, the turbine 100 may reduce the reattachment length S of the cooling fluid and have the cooling fluid collide with the inner surface 121*i* of the blade body unit 121 so as to inhibit a rise in temperature of the blade 120. In addition, a life span of the turbine 100 may be extended by inhibiting the rise in temperature of the blade 120.

As described above, according to the one or more of the above exemplary embodiments, a turbine may reduce a reattachment length of a cooling fluid, which flows in a blade, and rapidly and effectively cool the blade.

It should be understood that the exemplary embodiments described therein should be considered in a descriptive sense only and not for purposes of limitation. Descriptions of features or aspects within each embodiment should typically be considered as available for other similar features or aspects in other embodiments.

While exemplary embodiments have been particularly shown and described above, it will be understood by those of ordinary skill in the art that various changes in form and details may be made therein without departing from the spirit and scope of the inventive concept as defined by the following claims.

What is claimed is:

1. A turbine comprising:

a rotor;

a blade provided on the rotor and comprising a cooling flow path through which a cooling fluid flows; and a shroud surrounding an exterior of the blade, wherein the blade comprises:

a plurality of rib turbulators being provided in a single cavity and protruding into the cooling flow path in a circumferential direction of the turbine, the plurality of rib turbulators comprising a first rib turbulator and a second rib turbulator, each of the first and second rib turbulators having a rectangular shape in a plan view being viewed on a plane extending perpendicular to the circumferential direction of the turbine; and a plurality of subsidiary protrusions protruding in the circumferential direction of the turbine from an outer surface of each of the first and second rib turbulators, each of the plurality of subsidiary protrusions having a rectangular shape in the plan view, wherein the first and the second rib turbulators in the single cavity are spaced apart from each other in an axial direction of the turbine thereby exposing an inner surface of the blade between the first and second rib turbulators, wherein the plurality of subsidiary protrusions of each of the first and second rib turbulators are spaced apart from each other in the axial direction of the turbine, wherein each of the plurality of rib turbulators extends in the axial direction form a first angle with a flow direction of the cooling fluid, wherein the plurality of subsidiary protrusions extending in the axial direction form a second angle with the flow direction of the cooling fluid, the first and second angles being formed on the plane, and wherein the first angle and the second angle are different from each other.

2. The turbine of claim 1, wherein the plurality of rib turbulators protrude into the cooling flow path to face one another.

3. The turbine of claim 1, wherein the plurality of rib turbulators are provided apart from one another along the cooling flow path.

4. The turbine of claim 1, wherein the plurality of subsidiary protrusions are arranged in a straight line apart from one another in the axial direction, and wherein the straight line along which the plurality of subsidiary protrusions are disposed forms an angle with respect to a flow direction of the cooling fluid which flows in the cooling flow path.

5. The turbine of claim 1, wherein the plurality of subsidiary protrusions are provided on a top surface of each of the plurality of rib turbulators at a downstream side of a flow direction of the cooling fluid that flows in the cooling flow path.

6. The turbine of claim 1, wherein a primary elongation direction of each of the plurality of subsidiary protrusions is along the axial direction of the turbine.

7. The turbine of claim 6, wherein the plurality of subsidiary protrusions are spaced apart from one another in the axial direction.

8. The turbine of claim 1, wherein a width of each of the plurality of subsidiary protrusions along the cooling flow path is smaller than that of each of the rib turbulators.

9. The turbine of claim 8, wherein a length of each of the plurality of subsidiary protrusions along the axial direction is smaller than that of each of the rib turbulators.

10. A turbine comprising:

a rotor;

a blade provided on the rotor and comprising a cooling flow path through which a cooling fluid flows; and a shroud surrounding an exterior of the blade, wherein the blade comprises:

a plurality of rib turbulators provided in a single cavity and protruding into the cooling flow path in a circumferential direction of the turbine; and at least one subsidiary protrusion protruding from an outer surface of each of the plurality of rib turbulators, wherein the plurality of rib turbulators in the single cavity comprise a first rib turbulator and a second rib turbulator, wherein the first rib turbulator protrudes from a first inner face in the circumferential direction of the turbine and the second rib turbulator protrudes from a second inner face in the circumferential direction of the turbine, the second inner face facing the first inner face of a blade body unit, wherein each of the first and second rib turbulators has a rectangular shape in a plan view being viewed on a plane extending perpendicular to the circumferential direction of the turbine, and wherein each of the plurality of subsidiary protrusions has a rectangular shape in the plan view.

11. The turbine of claim 1, wherein a length and a width of each of the plurality of rib turbulators measured on the plane are larger than those of each of the plurality of subsidiary protrusions measured on the plane.

12. The turbine of claim 1, wherein a length and a width of each of the plurality of rib turbulators, respectively measured in an axial and radial direction of the turbine, are larger than those of each of the at least one subsidiary protrusions.

* * * * *